US011952766B1

(12) United States Patent
Perez et al.

(10) Patent No.: US 11,952,766 B1
(45) Date of Patent: Apr. 9, 2024

(54) SEMI-HIDDEN TOILET WATER FLUSHING HANDLE SYSTEM

(71) Applicants: Ariel Arnaldo Perez, Moreno (AR); Nicolás Martín Biach, Ituzaingó (AR)

(72) Inventors: Ariel Arnaldo Perez, Moreno (AR); Nicolás Martín Biach, Ituzaingó (AR)

( * ) Notice: Subject to any disclaimer, the term of this patent is extended or adjusted under 35 U.S.C. 154(b) by 0 days.

(21) Appl. No.: 18/132,606

(22) Filed: Apr. 10, 2023

(51) Int. Cl.
*E03D 5/09* (2006.01)

(52) U.S. Cl.
CPC ..... *E03D 5/09* (2013.01)

(58) Field of Classification Search
CPC .. E03D 5/026; E03D 5/04; E03D 5/09; E03D 5/092; A47K 13/245
USPC ..... 4/249, 405, 236, 242.1, 408, 410, 411, 4/412, 413, 414; D23/311, 312
See application file for complete search history.

(56) References Cited

U.S. PATENT DOCUMENTS 5,435,016 A * 7/1995 Smith ..... A47K 13/24 4/234
5,689,838 A * 11/1997 MacKenzie ..... A47K 13/10 4/246.1
5,768,718 A * 6/1998 Sorimachi ..... A47K 13/12 4/236
5,771,502 A * 6/1998 O'Grady ..... E03D 5/026 4/405
5,907,873 A * 6/1999 Brandolf ..... A47K 13/10 4/246.1
6,212,694 B1 * 4/2001 Porzio ..... A47K 13/105 16/905
11,105,079 B1 * 8/2021 Woodring ..... E03D 5/026
2005/0055756 A1 * 3/2005 Curtis ..... A47K 13/105 4/246.1
2005/0273919 A1 * 12/2005 Berlovan ..... E03D 5/092 4/405
2006/0130230 A1 * 6/2006 Lalicata ..... A47K 17/00 4/661
2015/0033461 A1 * 2/2015 Ahmady ..... E03D 1/14 4/324
2015/0059072 A1 * 3/2015 Jochim ..... E05F 5/00 4/236

* cited by examiner

*Primary Examiner* — David P Angwin
*Assistant Examiner* — William R Klotz
(74) *Attorney, Agent, or Firm* — Mariana I. Vernieri

(57) ABSTRACT

A semi-hidden system for the water flushing handle of toilets that forces the user to lower the lid or lid and seat before activating the flushing of the cistern. The flushing handle is embedded in the front wall of the cistern in such a way that a portion of the handle is covered by the lid of the toilet when the lid is raised, forcing users to close the lid in order to be able to flush, and thus substantially reducing the emission of infectious and polluting bioaerosols. The system aims to contribute to preventive medicine and to improve health worldwide by avoiding contagion of diseases. The toilet lid and seat, which combine with the semi-hidden flushing system, complement the innovative system with fast soft-closing hinges. This invention can be used in public restrooms, homes, hospitals, hotels, schools, and other environments where sanitation is a high priority.

3 Claims, 2 Drawing Sheets

SEMI-HIDDEN TOILET WATER FLUSHING HANDLE SYSTEM

CROSS-REFERENCE TO RELATED APPLICATION

The present application is related to application Ser. No. 18/132,584, filed on the same date as the present application by the same applicants and inventors, which is incorporated by reference herein in its entirety and hereinafter referred to as "Patent Application 1"

FIELD OF THE INVENTION

This invention relates to the field of toilet lid and seat closure mechanisms and flushing systems. More specifically, the present invention refers to a semi-hidden system for the toilet flushing handle, which has the objective of forcing the user to lower the lid or lid and seat of the toilet before activating the cistern's flushing of water.

BACKGROUND OF THE INVENTION

The emission of bioaerosols after a toilet flush was first studied in the 1950s, when a bacterium was "sowed" in various types of toilets and the bioaerosols produced during the flush were measured. The cultured particles could be trapped in the air 8 minutes after flushing and they were detected at a height of 150 cm from the ground. Toilet flushes produce infectious bioaerosols, small enough to be directly inhaled by the person releasing the flush (microscopic), entering deeply into the lungs, being able to cause contagion by pathogenic germs from third parties and even self-infection. They may remain in the environment for long periods of time (hours, days and even months) and may be transported by air currents. Cross contamination occurs to all kinds of surrounding environments. In addition, pathogens can be transmitted through all kinds of inanimate objects (fomites) on all bathroom surfaces, by indirect contact (infected hands touch the mucous membranes of the mouth, nose or eyes, generating contagion).

This means that there is a very serious risk of spreading infectious germs present in the toilet up to 4 and a half meters away. If there is a family member with a mild, serious or fatal illness, the toilet flush causes splashes, invisible to human sight, or particle aerosol that can be inhaled, come in contact with the mucosa of the eyes-nose-mouth, or deposited on contact surfaces around the bathroom, producing imminent contagion.

By not closing the toilet lid, pathogenic germs are deposited on absolutely all surfaces and/or fomites inside the bathroom, they remain on your body, on your cell phone, and can be transported to environments where there is food and other objects. It is definitely bad for health. Urine is also dangerous, as it can transmit infectious agents when it comes into contact with the mucous membranes of the eyes-nose-mouth. The process that occurs when flushing, lowering the toilet lid, and in which an "infectious microbial bomb" explodes and disperses with the swirling water, is called: "Toilet plume", causing a huge cloud of particles that splash all over the bathroom. The toilet can contain urine, blood, sperm, feces, viruses, bacteria, fungi, vomit, thousands of infectious agents, which are capable of transmitting diseases, such as hepatitis A, B, E, tuberculosis, gastritis, cholera, dysentery, *salmonellosis*, shigellosis, amoebiasis, giardiasis, COVID-19 and many other diseases. It is noteworthy that enteric and gastroenteric diseases are the main cause of death of children from 0 to 6 years of age worldwide.

The World Health Organization warned that diseases can be spread through fomites (examples of surfaces contaminated by not lowering the lid: floor, bidet, mirrors, faucets, door, walls, towels, shower curtain, sink, label handle door, toothbrushes, combs, toilet paper). If an object is contaminated with a pathogen such as a virus, it is capable of being transferred from one individual to another when they touch it with their hands and later make contact with the mucous membranes of the eyes-nose-mouth. For these reasons, the WHO recommends lowering the toilet lid. In addition, data from the United Nations and the World Health Organization report that 600 million families share a toilet with other families worldwide. COVID-19 is spread in the feces of infected people, which helps explain why it spreads so quickly. Feces are another contagion vehicle, in addition to the airway. The finding of live virus particles in stool samples indicates a fecal-oral route. The virus was found in oral, anal, and blood swabs. This indicates that infected patients, both symptomatic and asymptomatic, are capable of eliminating the pathogen through the fecal-oral route and causing contagion.

Despite the efforts of the prior art to address the issue of the emission of bioaerosols after a toilet flush, these solutions have several shortcomings, due to the fact that more than 98% of the world's population does not manually lower the toilet lid before flushing.

For example, on some ships and airplanes, as well as on land vehicles that have toilets and chemical toilets, it is common to emphasize that the lid must be closed before flushing, not so much for health reasons but for safety, since in these systems, which work with vacuum and toxic chemicals, it is not safe to start flushing with the lid open. Therefore, it is common to find this type of design on cruise ships, where the Water Flushing Button is located behind the lid, forcing the user to close the lid to uncover the Water Flushing Button. However, these systems have two major disadvantages: firstly, there are frequent complaints that, as it is a front push button located just behind the toilet lid, it is accidentally activated by the pressure of the user's back against the toilet seat, at inconvenient times when the user is still seated, causing serious health risks. On the other hand, it is also a possibility that users who cannot see any push button, as it is hidden behind the lid, may not know how to activate the water flush, and end up deciding not to do so, worsening the sanitation situation even further. For this reason, a handle that has a visible part located behind the lid would solve this problem and eliminate the need to include explanatory signs, as the mere fact of seeing a part of the handle peeking behind the lid or lid and seat would make it evident that it is necessary to lower the lid to be able to activate the flush comfortably.

For these reasons, we believe that providing a Semi-Hidden System for the toilet water flushing handle, in which only a part of the handle is visible behind the toilet lid when the lid or lid and seat are raised, requiring the lid or lid and seat of the toilet to be lowered first in order to activate the handle and subsequently carry out the water flush, is a way to address the problem of bioaerosol emission by ensuring that the toilet lid is properly closed before flushing, thus constituting a solution to a long-standing, unresolved problem and need, and advancing the field.

SUMMARY OF THE INVENTION

The present invention consists of a semi-hidden system for the toilet water flushing handle ("handle") that forces the user to lower the toilet lid or lid and seat before activating the flushing of the cistern. The system comprises a water flushing handle located partially behind the toilet lid or lid and seat, so that the user can see it but cannot activate it without lowering the lid or lid and seat.

Although designs may vary, this handle mainly consists of two parts: an elongated arm, which is the part that needs to be pushed down in order to activate the flush, and is hidden behind the toilet lid when it is raised, making it inaccessible unless the lid or lid and seat are lowered; and a pivot inserted in the front wall of the cistern, connected to the elongated arm of the water flushing handle, (for example having the shape of a cylindrical button). Unlike the elongated arm, it is visible when the toilet lid or lid and seat are raised, so that the user knows intuitively and without any inconvenience how to flush. Apart from this innovation that marks a strategic difference in location, the flushing operation is the same as in traditional toilets.

The toilet lid and seat, which combine with the semi-hidden flushing system, complement the innovative system with soft-closing hinges.

System Operation

The water flushing handle is located in the position indicated in the illustrations, on the front wall of the toilet cistern, so that its elongated arm is hidden by the toilet lid or lid and seat, but its cylindrical button (pivot) is visible when the lid or seat is raised. The user must lower the toilet lid or seat before being able to activate the hidden arm of the water flushing handle. By having the handle semi-hidden behind the lid, the only alternative to activate the water flushing handle is to first lower the lid or lid and seat, thus fulfilling the purpose of the invention.

High Global Impact on Public and Private Health

Four main objectives of the system are to contribute to preventive medicine, to improve the health of the entire population worldwide, (global impact), to avoid contagion of diseases and in many cases deaths by avoiding contagions, and to generate a high impact in the fight against environmental pollution that in this particular case affects the entire built environment (intra-environmental, intra-hospital, intra-buildings in general, etc.) The benefit is for everyone: public restrooms, homes, shopping malls, business, restaurants, hospitals, hotels, airplanes, schools, universities, cruises and more.

The system substantially reduces the emission of bioaerosols by closing the lid and seat, (or just the lid if the seat is already down), before flushing the toilet, as the seat is also complemented with a sealing rubber on the toilet bowl and the lid with a sealing rubber bellows against the seat, acting as a hermetic and antimicrobial barrier. Other materials with specific characteristics that offer the hermetic function that was mentioned earlier can also be incorporated. An accessory handle on the proximal end of the seat is also considered so that it can be raised without contact on it. It could be made of stainless steel, for example, to facilitate its sanitization and avoid disease transmission.

When the toilet is flushed, the water and waste in the bowl are forced out through the drainpipe, and the closing of the helps to contain the bioaerosols within the toilet bowl and prevent them from being released into the air. This system, which can leave the factory already incorporated into new toilets, can also be used and marketed as an independent accessory to be adapted to the hundreds of millions of existing toilets worldwide.

DETAILED DESCRIPTION OF THE INVENTION

Figure 1:
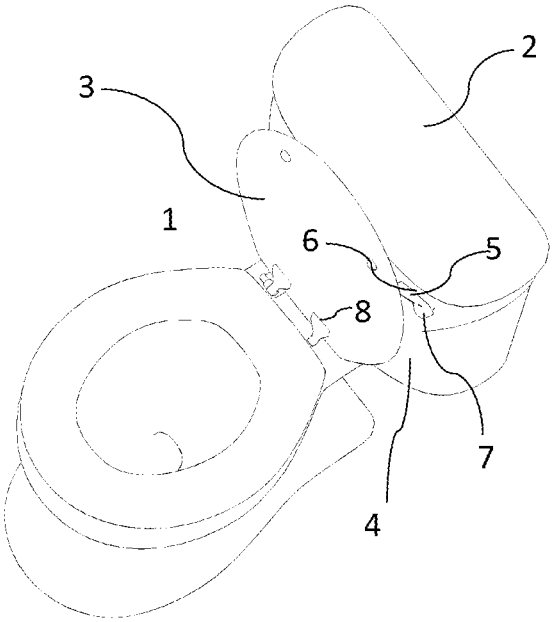
FIG. 1 is a perspective view of an embodiment of the SEMI-HIDDEN TOILET WATER FLUSHING HANDLE SYSTEM, according to the present invention.

Conventional toilets usually have a water flushing mechanism that is easily accessible and operable by the user. However, the use of these systems generates in each water flush the emission of bioaerosols, which are particles of water, feces, urine, and pathogenic germs such as bacteria and viruses. These bioaerosols are highly contaminating and represent a health risk to people and in the environment, causing the spread of infectious diseases transmitted through urine-oral and fecal-oral transmission. The present invention consists of a semi-hidden toilet water flushing handle system that forces the user to lower the toilet lid or lid and seat before activating the water flush from the cistern. This is achieved by strategically hiding a part of the handle (lever) behind the toilet lid when raised, while leaving another part of the handle (the pivot or cylindrical button) visible so that the user can easily understand how to use it without the need for explanatory signs. An elongated arm, hidden behind the toilet lid when the lid or lid and seat are raised, prevents access to it unless the lid or lid and seat are lowered, and a visible cylindrical button, connected to the elongated arm of the water flushing handle, which is the pivot point of the handle, and which, unlike the elongated arm, remains visible even when the toilet lid is raised, so that the user intuitively knows how to activate the flush. The toilet lid and seat, which combine with the semi-hidden system, complement the innovative system with soft-closing hinges. Adjusting/manufacturing the hinges of the covers and seats for an extremely fast dropping of 2 to 3 seconds is preferred. To further improve the effectiveness of the system, a timer can be added so that it delays the flush for a few seconds to allow time for the lid to finish closing before flushing. An example of implementation of this timer would be to place it inside the toilet cistern, interconnected between the flush valve and the flush handle. Other timer systems may also be applied without departing from the spirit and scope of the following invention, which a person of ordinary skill in the art could derive from the teachings of this specification.

The system technically achieves:

a) Completely eliminating the transmission and contagion of thousands of diseases through the fecal-oral and urine-oral routes (directly or indirectly) derived from the infectious microscopic bioaerosol column (formed by fecal particles and pathogen germs) from toilets (invisible to the naked eye), to avoid the spread and transmission of diseases.

b) Preventing in many cases deaths in all the inhabitants of the world, regardless of place, country, sex, age and purchasing power.

c) Avoiding the huge suffering of contracting some of the diseases detailed below.

d) Decreasing the death rate worldwide, and also a great economic benefit for public health: the governments of each country will spend less on hospital care.

Diseases Transmitted Via the Fecal-Oral and Urine-Oral Routes

Following is a list of mild, severe and fatal infectious diseases transmitted by the fecal-oral and urine-oral routes, through the pathogenic germs that generate them (viruses, bacteria, protozoa, etc.). It is important to highlight that this list of 47 diseases is not exhaustive and definitive. In reality, there are even more, generated by thousands of existing strains, so the number of diseases to avoid is measured in the hundreds or thousands. By way of example, in a single flushing of water, feces can contain up to 200 Rotavirus cells, 20 billion *Shigella* Bacteria and 100,000 parasite eggs.

1. Hookworm disease

Infectious agent that produces it: nematode/worm/parasite. Hookworm disease caused by *Necator americanus. Ancylostoma duodenale. Ancylostoma* brasiliense. *Ancylostoma ceylanicum.*

Symptoms: anemia, abdominal pain, cough, bloody diarrhea, fatigue, fever, rash, excessive weight loss, lung problems, gastrointestinal problems, heart failure, etc.

Severity level: mild, severe and fatal.

2. Balantidiasis

Infectious agent that produces it: protozoon. *Balantidium coli.*

Symptoms: diarrhea with blood and pus, nausea and vomiting, excessive weight loss, severe dehydration, high fever, headache, etc.

Severity level: mild, severe and fatal.

3. Botulism

Infectious agent that produces it: bacteria. *Clostridium botulinum*

Symptoms: abdominal pain, constipation, vomiting, fatigue, blurred or double vision, difficulty speaking, swallowing and breathing, muscle paralysis, loss of reflexes, etc.

Severity level: mild, severe and fatal.

4. Mononucleosis

Infectious agent that produces it: virus. Cytomegalovirus.

Symptoms: fever, fatigue, sore throat, muscle aches, etc.

Severity level: mild, severe and fatal.

5. Cholera

Infectious agent that produces it: bacteria. *Vibrio cholerae.*

Symptoms: intense diarrhea, severe dehydration, vomiting, muscle cramps, hypovolemic shock, blood pressure alteration, etc.

Severity level: mild, severe and fatal.

6. Ebola

Infectious agent that produces it: virus. Ebola virus.

Symptoms: pain in the abdomen, headache, throat, joints, muscles and chest. Dehydration, fever, diarrhea, vomiting blood, coughing up blood, etc.

Severity level: mild, severe and fatal.

7. Strongyloidiasis

Infectious agent that produces it: ascarid. *Strongyloides stercoralis.*

Symptoms: cough, rash, diarrhea, vomiting, etc.

Severity level: mild, severe and fatal.

8. Bacillary and Amoebic Dysentery

Infectious agent that produces it: bacteria. *Shigella* for Bacillary Dysentery, and Amoeba called *Entamoeba histolytica* for Amebic Dysentery.

Symptoms: bloody diarrhea, abdominal pain, colic, fever, dehydration, cramps, excessive weight loss, etc.

Severity level: mild, severe and fatal.

9. Enteritis caused by Rotavirus

Infectious agent that produces it: virus. Rotavirus.

Symptoms: abdominal pain, cramps, colic, excessive weight loss, watery diarrhea, vomiting, dehydration, high fever, etc.

Severity level: mild, severe and fatal.

10. Enteritis caused by Adenovirus

Infectious agent that produces it: virus. Adenovirus.

Symptoms: diarrhea, abdominal pain, blood in the urine, bladder pain, high fever, etc.

Severity level: mild, severe and fatal.

11. Enteritis caused by *Campylobacter*

Infectious agent that produces it: virus. *Campylobacter.*

Symptoms: diarrhea, abdominal pain, blood in the urine, bladder pain, high fever, etc.

Severity level: mild, severe and fatal.

12. Enteritis caused by *Yersinia Enterocolitica*

Infectious agent that produces it: bacteria. *Yersinia.*

Symptoms: diarrhea, abdominal pain, blood in the urine, bladder pain, high fever, etc.

Severity level: mild, severe and fatal.

13. Enterocolitis caused by *Clostridium Difficile*

Infectious agent that produces it: bacteria. *Clostridium difficile.*

Symptoms: diarrhea, abdominal pain, blood in the urine, bladder pain, high fever, etc.

Severity level: mild, severe and fatal.

14. Enterocolitis caused by Enterovirus

Infectious agent that produces it: virus. Enterovirus.

Symptoms: diarrhea, abdominal pain, blood in the urine, bladder pain, high fever, etc.

Severity level: mild, severe and fatal.

15. Norwalk Gastroenteritis

Infectious agent that produces it: virus. Norwalk.

Symptoms: diarrhea, abdominal pain, blood in the urine, bladder pain, high fever, etc.

Severity level: mild, severe and fatal.

16. Acute viral gastroenteritis

Infectious agent that produces it: virus. Norovirus.

Symptoms: diarrhea, abdominal pain, blood in the urine, bladder pain, high fever, etc.

Severity level: mild, severe and fatal.

17. Acute bacterial gastroenteritis

Infectious agent that produces it: bacteria. *Helicobacter Pylori* (high degree of lethality).

Symptoms: diarrhea, abdominal pain, blood in the urine, bladder pain, high fever, etc.

Severity level: mild, severe and fatal.

18. Giardiasis

Infectious agent that produces it: protozoan parasite. Giardia.

Symptoms: chronic diarrhea, impaired mental and physical development, lactose intolerance, etc.
Severity level: mild, severe and fatal.
19. Hantavirus
Infectious agent that produces it: virus. Hantaviridae.
Symptoms: high and hemorrhagic fever, headache, muscle aches, cough, lung problems, etc.
Severity level: mild, severe and fatal.
20. Hepatitis A
Infectious agent that produces it: Highly contagious liver infection caused by the Hepatitis A virus.
Symptoms: Symptoms include fatigue, nausea, abdominal pain, loss of appetite, and low-grade fever. Joint pain, headache, inflammation of the liver.
Severity level: mild, severe and fatal.
21. Hepatitis B
Infectious agent that produces it: Serious liver infection caused by the Hepatitis B virus.
Symptoms: Symptoms include fatigue, nausea, abdominal pain, loss of appetite, and low-grade fever. Joint pain, headache, inflammation of the liver. Cirrhosis, liver cancer.
Severity level: mild, severe and fatal.
22. Hepatitis E
Infectious agent that produces it: Liver disease caused by the Hepatitis E virus.
Symptoms: Symptoms include jaundice, lack of appetite, and nausea.
Severity level: mild, severe and fatal.
23. Enterohemorrhagic *Escherichia Coli*
Infectious agent that produces it: bacteria. *E. coli*
Symptoms: Cramps, abdominal pain, diarrhea, severe bleeding, intestinal infections, etc.
Severity level: mild, severe and fatal.
24. Enteroinvasive *Escherichia Coli*
Infectious agent that produces it: bacteria. *Escherichia coli*
Symptoms: Cramps, abdominal pain, diarrhea, severe bleeding, intestinal infections, etc.
Severity level: mild, severe and fatal.
25. Enteropathogenic *Escherichia Coli*
Infectious agent that produces it: bacteria. *Escherichia coli*
Symptoms: Cramps, abdominal pain, diarrhea, severe bleeding, intestinal infections, etc.
Severity level: mild, severe and fatal.
26. *Escherichia Coli* Enterotoxins
Infectious agent that produces it: bacteria. *Escherichia coli*
Symptoms: Cramps, abdominal pain, diarrhea, severe bleeding, intestinal infections, etc.
Severity level: mild, severe and fatal.
27. Enteroaggregative *Escherichia Coli*
Infectious agent that produces it: bacteria. *Escherichia coli*
Symptoms: Cramps, abdominal pain, diarrhea, severe bleeding, intestinal infections, etc.
Severity level: mild, severe and fatal.
28. *Escherichia Coli* Diffuse Adhesion
Infectious agent that produces it: bacteria. *Escherichia coli*
Symptoms: Cramps, abdominal pain, diarrhea, severe bleeding, intestinal infections, etc.
Severity level: mild, severe and fatal.
29. Cryptosporidiosis
Infectious agent that produces it: parasite. *Cryptosporidium.*
Symptoms: diarrhea, abdominal pain, blood in the urine, bladder pain, high fever, etc.
Severity level: mild, severe and fatal.
30. *Isospora*
Infectious agent that produces it: parasite. *Isospora Belli.*
Symptoms: diarrhea, abdominal pain, fever, dehydration, etc.
Severity level: mild, severe and fatal.
31. *Bacillus cereus*
Infectious agent that produces it: bacteria. *Bacillus Cereus.*
Symptoms: emetic syndrome or diarrheal syndrome. Fever, dehydration, abdominal pain, headache, bloody stools, abdominal cramps, poisoning, etc.
Severity level: mild, severe and fatal.
32. *Clostridium perfringens*
Infectious agent that produces it: bacteria with eight lethal toxins. *Clostridium.*
Symptoms: watery diarrhea, nausea, colic, abdominal pain, headache, poisoning, etc.
Severity level: mild, severe and fatal.
33. *Staphylococcus*
Infectious agent that produces it: bacteria. Bacilli.
Symptoms: skin infections, boils, blood infections, bone infections, lung infections, poisoning, etc.
Severity level: mild, severe and fatal.
34. *Klebsiella*
Infectious agent that produces it: bacteria. *pneumoniae.*
Symptoms: urinary and biliary tract infections, osteomyelitis, meningitis, septicemia, pneumonia, fever, tachycardia, etc.
Severity level: mild, severe and fatal.
35. Malaria
Infectious agent that produces it: parasite. *Plasmodium.*
Symptoms: abdominal pain, muscle pain. Fatigue, fever, tremors, diarrhea, vomiting, headache, tachycardia, confusion, etc.
Severity level: mild, severe and fatal.
36. Epidemic Pleurodynia or Bornholm Disease
Infectious agent that produces it: virus. Enterovirus.
Symptoms: intense pleural and chest pain. Abdominal pain, fever, myocarditis, etc.
Severity level: mild, severe and fatal.
37. *Salmonellosis*
Infectious agent that produces it: bacteria. *Salmonella.*
Symptoms: diarrhea, fever, abdominal pain, muscle pain and headache, dehydration, bloody diarrhea, excessive weight loss, fatigue, chills, etc.
Severity level: mild, severe and fatal.
38. Poliomyelitis
Infectious agent that produces it: virus. poliovirus.
Symptoms: atrophy, fatigue, fever, dizziness, muscle loss, slow growth, headaches, nausea, vomiting.
Severity level: mild, severe and fatal.
39. Rubella
Infectious agent that produces it: virus. Rubella.
Symptoms: fever, nasal congestion, headache, body aches, enlarged neck lymph nodes, body rashes, cardiac disorders, diabetes, thyroid dysfunction, etc.
Severity level: mild and severe.
40. Typhoid Fever
Infectious agent that produces it: bacteria. *Salmonella typhi.*
Symptoms: abdominal pain, muscle aches, headaches, diarrhea, vomiting, fever, fatigue, chills, extreme weight loss, etc.
Severity level: mild, severe and fatal.

41. Shigellosis

Infectious agent that produces it: bacteria. *Shigella*. It has 3 strains.

Symptoms: bloody diarrhea, abdominal pain, headache, intestinal fever.

Severity level: mild, severe and fatal.

42. Trachoma

Infectious agent that produces it: bacteria. *Chlamydia trachomatis*.

Symptoms: blindness (main infectious disease globally). Other symptoms: conjunctivitis, eye irritations.

Severity level: mild and severe.

43. Trichuriasis

Infectious agent that produces it: parasite. *Trichuris trichiura*.

Symptoms: abdominal pain, anemia, malnutrition, bloody diarrhea, rectal prolapse, etc.

Severity level: mild, severe and fatal.

44. Tuberculosis

Infectious agent that produces it: bacteria. Koch's *bacillus*.

Symptoms: chest pain, headache, coughing up blood, fatigue, fever, loss of appetite, breathing difficulties, swollen lymph nodes, weight loss, etc.

Severity level: mild, severe and fatal.

45. *Vibrio Parahaemolyticus* Gastroenteritis

Infectious agent that produces it: bacteria. *Vibrio Parahaemolyticus*.

Symptoms: diarrhea, abdominal and headache pain, nausea, vomiting, fever etc.

Severity level: mild, severe and fatal.

46. Intestinal or extraintestinal yersiniosis

Infectious agent that produces it: bacteria. *Yersinia*.

Symptoms: severe diarrhea, fever, cramps, intestinal pain, etc.

Severity level: mild, severe and fatal.

47. COVID-19

Infectious agent that produces it: infectious disease caused by the SARS-CoV-2 virus.

Symptoms: headache, shortness of breath, chills, muscle aches, pneumonia, fever, cough, tiredness, loss of taste or smell.

Severity level: mild, severe and fatal.

Superbugs

The World Health Organization (WHO) has published a list of superbugs for which new antibiotics are urgently needed. The list includes the 12 most dangerous and deadly families of bacteria worldwide, 7 of which will be mentioned below as they can be transmitted via the fecal-oral route, and 2 via the fecal-oral and urine-oral route. Said published list is a new tool to guarantee that research and development, such as the work carried out in this patent where we developed a preventive product for disease transmission and a complement to medication, responds to urgent global public health needs.

The WHO divides them into three categories based on the urgency in which new antibiotics, drugs, etc. are needed: critical, high or medium priority.

The critical priority group includes multi-resistant bacteria that can cause serious and often fatal infections, such as bloodstream infections and pneumonia.

The second and third levels of the list (the high and medium priority categories) contain other bacteria that exhibit increasing drug resistance and cause common diseases and food poisoning such as *salmonella*, etc.

Predictions suggest that by the year 2050 superbugs can cause 10 million deaths per year worldwide and many of these diseases are of great concern and impact for the United States, for instance.

Priority 1: CRITICAL

*Acinetobacter baumannii*, carbapenem-resistant: Can be transmitted via fecal-oral or urine-oral route.

*Pseudomonas aeruginosa*, carbapenem-resistant: Can be transmitted via fecal-oral or urine-oral route.

Enterobacteriaceae, carbapenem-resistant, ESBL producers: Can be transmitted by the fecal-oral route.

Priority 2: HIGH

*Enterococcus faecium*, vancomycin-resistant: Can be transmitted via fecal-oral route.

*Staphylococcus aureus*, methicillin-resistant (MRSA), with intermediate sensitivity and resistance to vancomycin: Can be transmitted via fecal-oral route.

*Helicobacter pylori*, clarithromycin-resistant: An infectious agent mentioned earlier in the List of Diseases. Can be transmitted via fecal-oral route.

*Campylobacter* spp., fluoroquinolone-resistant: A disease mentioned earlier in the List of Diseases. Can be transmitted via fecal-oral route.

Salmonellae, fluoroquinolone-resistant: A disease mentioned earlier in the List of Diseases. Can be transmitted via fecal-oral route.

Priority 3: MEDIUM

*Shigella*, fluoroquinolones-resistant: A disease already mentioned above in the List of Diseases. It can be transmitted by the fecal-oral route.

In addition, outside the WHO list, there is a strain of superbug called CRE that belongs to the group of Enterobacteriaceae, carbapenems-resistant and is lethal in 50% of cases. It is of great concern to public health because current drugs (between 26 and 28 antibiotics used) do not provide the required result. This strain was classified as a "Nightmare Bacteria" by the Director of the US Centers for Disease Control and Prevention (CDC), Tom Frieden. The CRE superbug can be transmitted through fecal-oral and urine-oral routes. The West Virginia Public Health Office indicated that infected patients often have the bacteria on their skin or hands and spread it through urine, feces, or wounds.

Some general aspects of the present invention have been summarized so far in the first part of this detailed description and in the previous sections of this disclosure. Hereinafter, a detailed description of the invention as illustrated in the drawings will be provided. While some aspects of the invention will be described in connection with these drawings, it is to be understood that the disclosed embodiments are merely illustrative of the invention, which may be embodied in various forms. The specific materials, methods, structures, and functional details disclosed herein are not to be interpreted as limiting. Instead, the intended function of this disclosure is to exemplify some of the ways—including the presently preferred ways—in which the invention, as defined by the claims, can be enabled for a Person of Ordinary Skill in the Art. Therefore, the intent of the present disclosure is to cover all variations encompassed within the spirit and scope of the invention as defined by the appended claims, and any reasonable equivalents thereof.

With reference to the drawings in more detail FIG. 1 shows a perspective view of the toilet (1) with the lid (3) raised. In this view, Soft-closing hinges (8) are shown and it can be appreciated how the semi-hidden handle (5) embedded in the front wall (4) of the cistern (2) is partially covered by the lid (3). The elongated arm (6) of the handle (5) remains hidden and inaccessible, while its cylindrical button (pivot) (7) is fully visible and exposed. Other embodiments have other shapes, and the pivot (7) does not necessarily need to have the shape of a cylindrical button as shown in this embodiment. What is important to all embodiments is that a part of the handle is hidden behind the lid (3) and another part is visible, preferably being the hidden part necessary to actuate the flush, so that the user is forced to lower the lid (3) to activate it. Additionally, in FIG. 2 we can see a front view of the toilet (1) with the lid (3) raised. Here, the lid (3) covers the elongated arm (6) of the handle (5) and only its cylindrical button (pivot) (7) is visible. The front wall (4b) of the cistern (4), where the handle (5) needs to be placed, is shown. Soft-closing hinges (8) are also shown in the figure. Adjusting/manufacturing the hinges (8) for an extremely fast dropping of two to three seconds is preferred.

Figure 2:
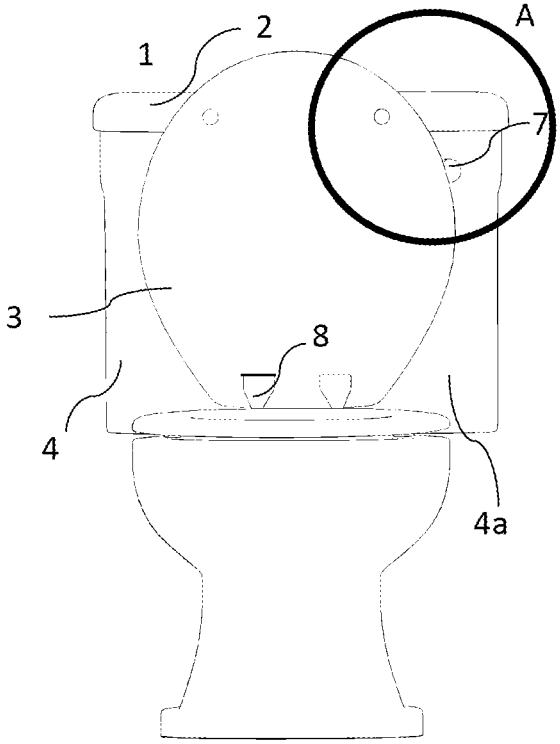
FIG. 2 is a front view of an embodiment of the SEMI-HIDDEN TOILET WATER FLUSHING HANDLE SYSTEM, according to the present invention, showing how the lid covers the elongated arm and only the cylindrical button (pivot point) is visible.
Figure 3:
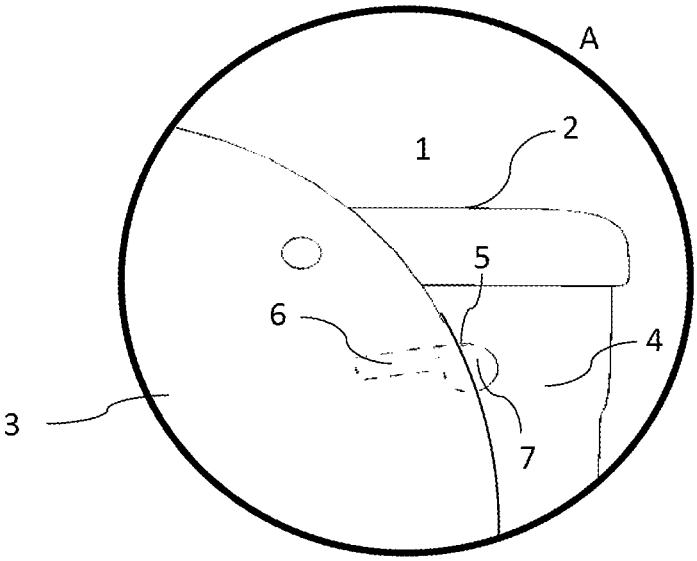
FIG. 3 is an enlargement of part A of FIG. 2, showing the handle part in more detail.

On the other hand, FIG. 3 is an enlargement of part A of FIG. 2, in which the semi-hidden handle (5) can be seen in more detail. The hidden part of the handle, its elongated arm (6), is shown in dashed lines, indicating that it is hidden behind the toilet lid (3).

Figure 4:
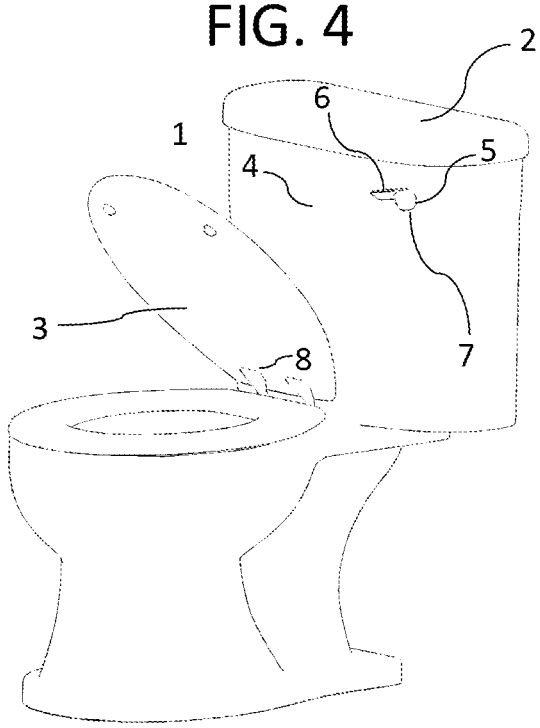
FIG. 4 is a perspective view of an embodiment of the SEMI-HIDDEN TOILET WATER FLUSHING HANDLE SYSTEM, according to the present invention, with the toilet lid partially open, showing how the complete water flushing handle becomes fully accessible when the lid is lowered.

In FIG. 4, a perspective view of the toilet with the lid (3) partially open is shown. In this view, it is completely clear how the complete handle (5, 6, and 7) becomes accessible to the user when lowering the toilet lid (3) with use of the Soft-closing hinges (8).

Figure 5:
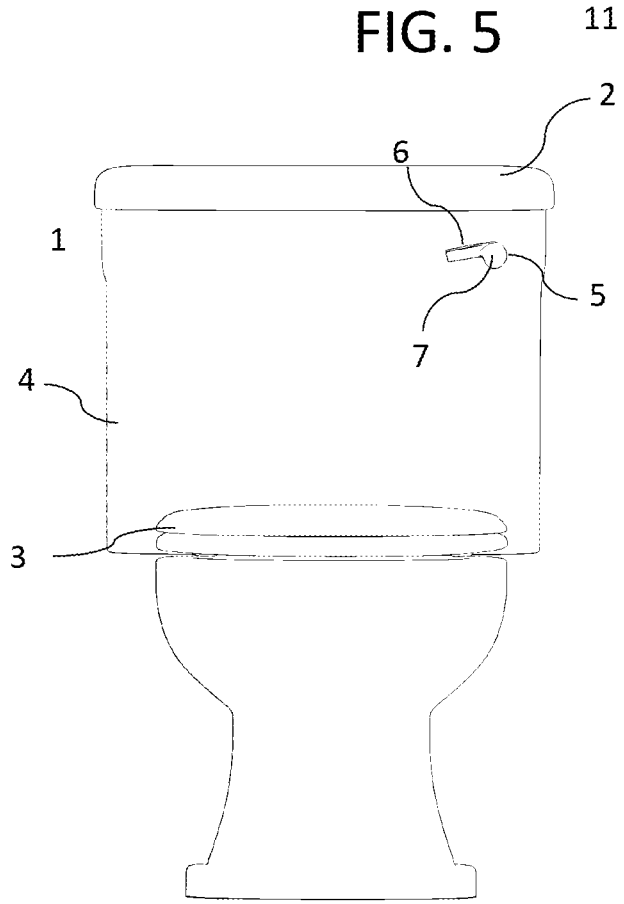
FIG. 5 is a front view of an embodiment of the SEMI-HIDDEN TOILET WATER FLUSHING HANDLE SYSTEM, according to the present invention, with the toilet lid lowered, showing how the complete handle becomes accessible when the lid or seat is lowered.

Finally, FIG. 5 presents a front view of the toilet with the lid (3) lowered. In this view, it can be observed how the complete handle (5, 6, and 7) is fully accessible so that the user can lower the toilet lid comfortably and easily.

The description as set forth is not intended to be exhaustive or to limit the invention to the precise form disclosed. Many modifications and variations are possible in light of the teachings above without departing from the spirit and scope of the forthcoming claims.

The invention claimed is:

1. A semi-hidden water flushing handle system for a toilet having a lid, a seat, and a cistern, said cistern having a front wall, said system comprising a single-piece handle responsible for flushing the water, wherein said single-piece handle comprises an elongated arm attached to a cylindrical pivot, said elongated arm having a tip, and wherein said handle is embedded in the front wall of the toilet cistern in such a way that said elongated arm is covered by the lid of the toilet when said lid is raised, said tip is fully covered by the lid of the toilet when said lid is raised, and said cylindrical pivot is fully exposed even when the lid of the toilet is raised, forcing users to close the lid in order to be able to flush.

2. A toilet comprising:

a) a cistern having a front wall;

b) a lid and a seat;

c) hinges that allow the lid to drop in two to three seconds; and d) a single-piece water flushing handle formed by an elongated arm and a cylindrical pivot, said elongated arm having a tip, where the elongated arm, when actuated, is responsible for flushing the water;

wherein said handle is embedded in the front wall of the toilet cistern in such a way that said elongated arm is covered by the lid of the toilet when said lid is raised, said tip is fully covered by the lid of the toilet when said lid is raised, and said cylindrical pivot is fully exposed even when the lid of the toilet is raised, forcing users to close the lid in order to be able to flush.

3. The toilet of claim 2 further comprising a mechanical timer to delay the water flush, allowing time for the lid to be fully closed before flushing.

* * * * *